US007128535B2

(12) United States Patent
Sucin et al.

(10) Patent No.: US 7,128,535 B2
(45) Date of Patent: Oct. 31, 2006

(54) TURBINE DRUM ROTOR FOR A TURBINE ENGINE

(75) Inventors: Gabriel Sucin, Glastonbury, CT (US); Brian Merry, Andover, CT (US)

(73) Assignee: United Technologies Corporation, Hartford, CT (US)

( * ) Notice: Subject to any disclaimer, the term of this patent is extended or adjusted under 35 U.S.C. 154(b) by 15 days.

(21) Appl. No.: 10/720,875

(22) Filed: Nov. 26, 2003

(65) Prior Publication Data

US 2005/0111970 A1 May 26, 2005

(51) Int. Cl.
*F01D 5/06* (2006.01)
*F01D 5/02* (2006.01)

(52) U.S. Cl. ..... 416/198 A; 416/201 R; 416/244 R; 416/213 R; 415/199.1; 29/889.2

(58) Field of Classification Search ..... 415/216.1, 415/199.1; 416/201 R, 198 A, 244 R, 213 R, 416/174; 29/889.2, 889.21, 889.22
See application file for complete search history.

(56) References Cited

U.S. PATENT DOCUMENTS

| | | | | | |
|---|---|---|---|---|---|
| 2,461,402 | A | * | 2/1949 | Whitehead | 416/201 R |
| 2,656,147 | A | * | 10/1953 | Brownhill et al. | 416/97 R |
| 3,249,293 | A | * | 5/1966 | Koff | 416/198 R |
| 3,692,429 | A | * | 9/1972 | Redding | 416/201 R |
| 3,700,353 | A | * | 10/1972 | Ortolano | 416/199 |
| 4,483,054 | A | * | 11/1984 | Ledwith | 29/889.2 |
| 4,743,165 | A | * | 5/1988 | Ulrich | 416/198 A |
| 4,844,694 | A | * | 7/1989 | Naudet | 416/198 A |
| 5,156,525 | A | * | 10/1992 | Ciokajlo | 415/199.5 |

* cited by examiner

*Primary Examiner*—Igor Kershteyn
(74) *Attorney, Agent, or Firm*—Bachman & LaPointe

(57) ABSTRACT

The present invention relates to an improved turbine structure for use in a gas turbine engine. The turbine structure includes a one-piece drum rotor and a plurality of turbine blades attached to the one-piece drum rotor. The one-piece drum rotor includes integrally formed, welded disks for supporting the plurality of turbine blades. A method for installing the turbine structure is also described.

15 Claims, 4 Drawing Sheets

TURBINE DRUM ROTOR FOR A TURBINE ENGINE

BACKGROUND OF THE INVENTION (a) Field of the Invention

The present invention relates to an improved structure for a turbine section of a gas turbine engine and in particular, to a low pressure turbine section having a one-piece drum and a plurality of blades attached to the drum.

(b) Prior Art

FIG. 1 illustrates a low pressure turbine section of a gas turbine engine. Currently, the low pressure turbine section has individually bladed rotors that are stacked one at a time into the low pressure turbine case followed by a set of stators. The next rotor is placed onto the previous one and the two are bolted together. This sequence is repeated until all blades and vanes are installed. Separate turbine disks have been necessary to allow this style of assembly to work. The separate turbine disks add complexity and, therefore, cost and weight because of the flanges between the disks that must be machined, drilled and bolted together.

Thus, there is a need for a turbine section that is less complex in structure and that has a reduced weight and cost associated with it.

SUMMARY OF THE INVENTION

Accordingly, it is an object of the present invention to provide an improved turbine structure for use in a gas turbine engine.

It is a further object of the present invention to provide an improved gas turbine structure which has a reduced complexity and a reduced weight and cost.

The foregoing objects are attained by the turbine structure of the present invention.

A turbine structure for use in a gas turbine engine is provided by the present invention. The turbine structure broadly comprises a one-piece drum rotor and a plurality of blades attached to the one-piece drum rotor.

A method for installing a section of a turbine is provided. The method broadly comprises the steps of installing a one-piece drum rotor with an upstream set of turbine blades attached to the one-piece drum rotor. The installing step comprises joining the one-piece drum rotor to an adjacent structure.

Other details of the turbine drum rotor for a turbine engine, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
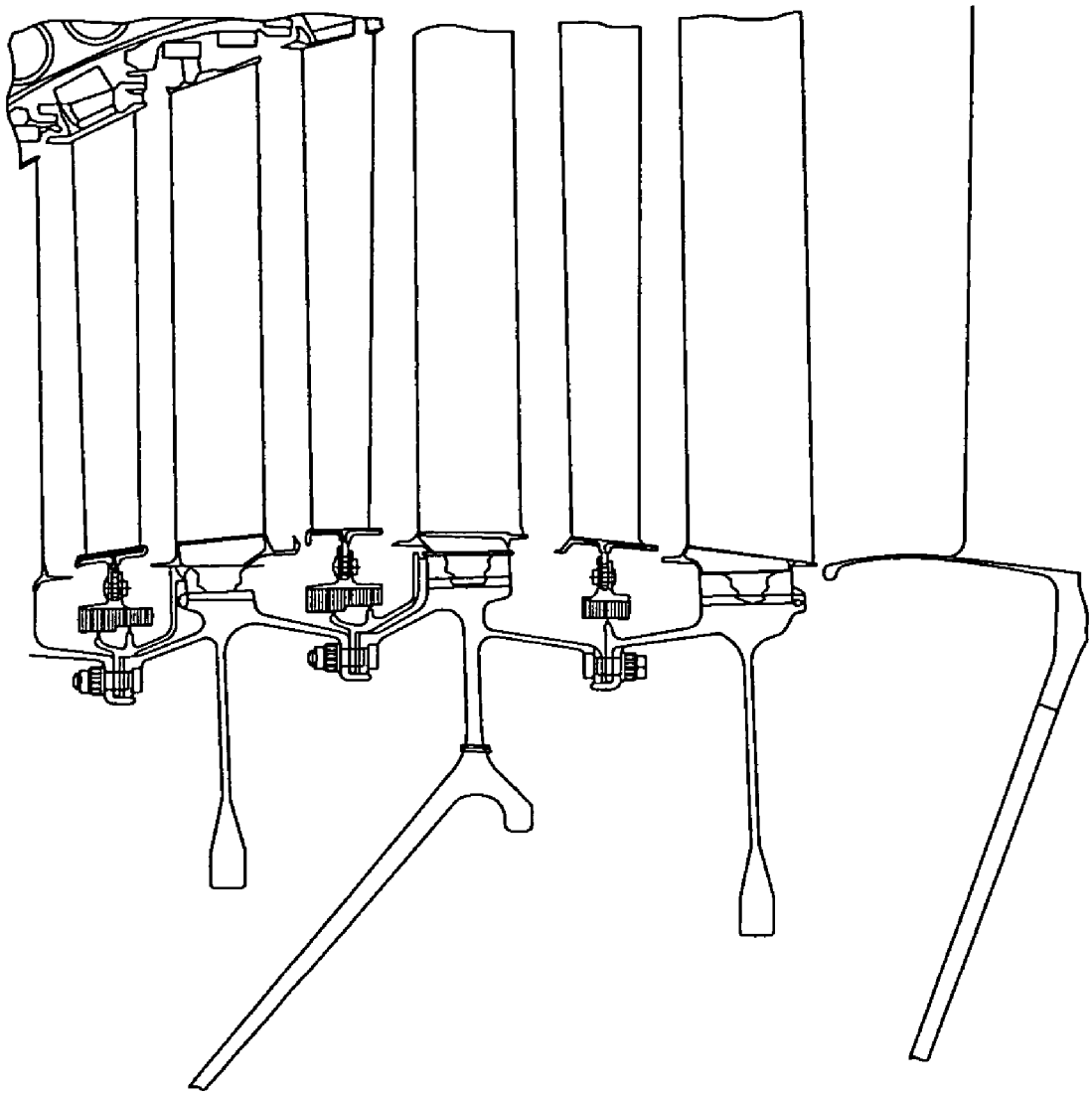
FIG. 1 (PRIOR ART)
FIG. 1 illustrates a prior art low pressure turbine section.
Figure 2:
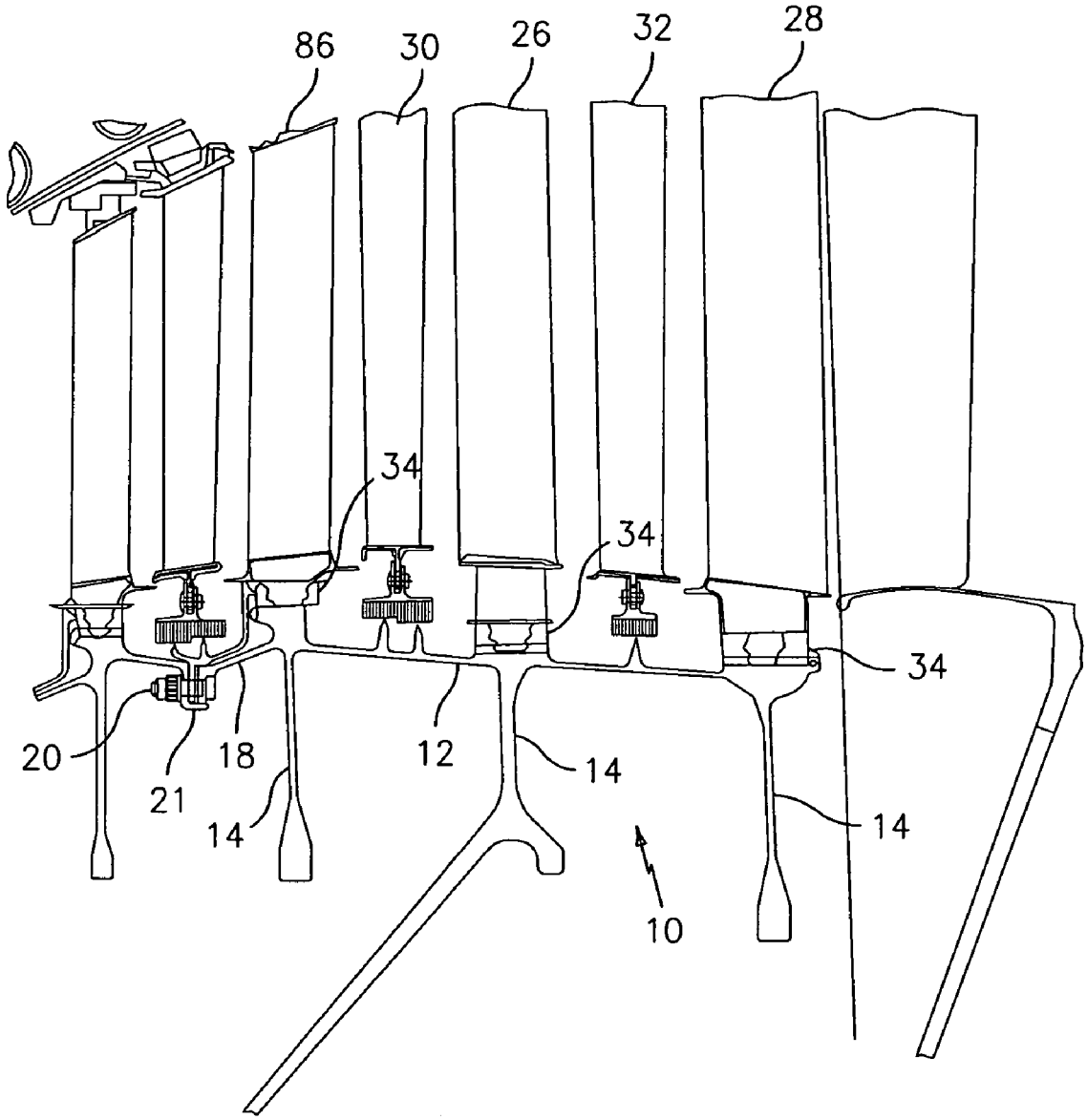
FIG. 2 illustrates a turbine structure in accordance with the present invention.

Referring now to FIG. 2, a turbine structure 10 for use in a gas turbine engine is illustrated. The turbine structure 10 has a one-piece drum rotor 12 where a plurality of axially spaced turbine disks 14 are welded together. As a result, the drum rotor 12 and the turbine disks 14 do not require additional machining, and bolts and nuts for joining them together. This results in a substantial reduction in weight and cost.

The one-piece drum rotor 12 is preferably joined to another stage of the turbine section of a gas turbine engine via an integrally formed flange 18 and a plurality of attachment means 20, such as a plurality of circumferentially arranged nut and bolt arrangements, which pass through apertures 21 in the flange 18. The drum rotor 12 may be supported for rotation in any suitable manner known in the art.

As can be seen from FIG. 2, the drum rotor 12 at the leading disk 14 has a diameter greater than the diameter of the trailing disk 14. By reducing the diameter of the drum rotor 12 in this manner, the disk diameter is reduced and additional clearance can be obtained. This allows axially spaced apart circumferential arrays of turbine blades 26 and 28 and axially spaced apart circumferential arrays of stator vanes 30 and 32 to be installed independently of the disks 14.

As can be seen from the figures, the drum rotor 12 has a plurality of integrally formed, axially spaced apart disk attachments 34 located circumferentially around the drum rotor 12. Each of the disk attachments 34 may have any desired configuration known in the art. Arrays of turbine blades 26, 28, and 36 may be joined to the disk attachments 34 using any suitable mounting technique known in the art, such as the fir tree arrangement shown in the figures.

Figure 3:
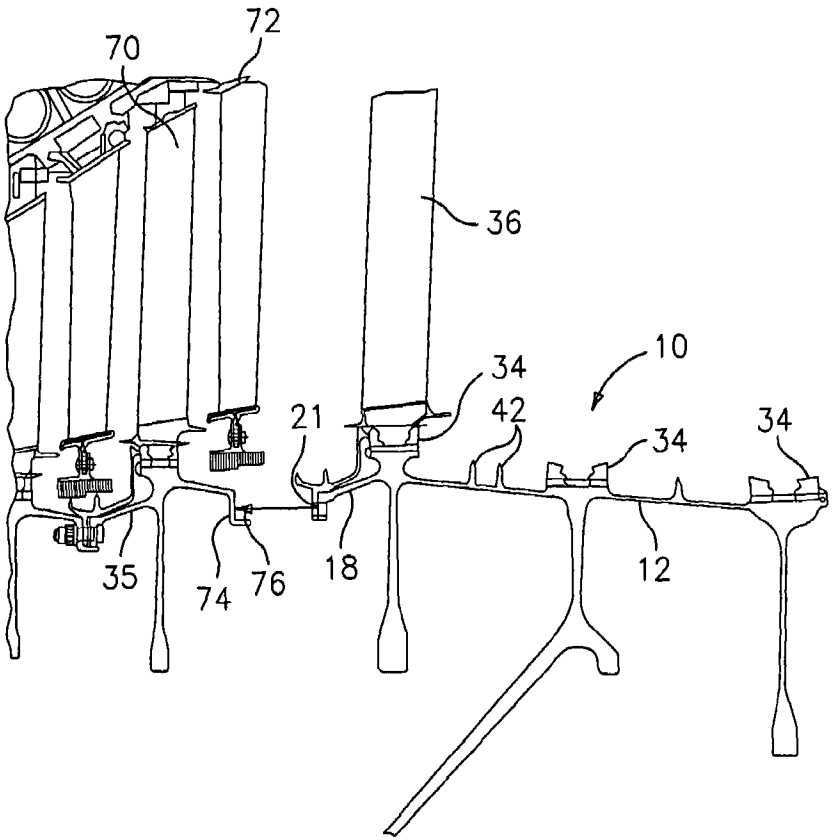
FIG. 3 illustrates an initial installation step using the turbine structure of the present invention.

As shown in FIG. 3, the turbine structure 10 may be installed with an upstream array of turbine blades 36 already attached. When positioned, the turbine structure 10 may be joined to the adjacent structure 35, which may have an array of turbine blades 70 and an array of stator vanes 72 attached thereto, by abutting flange 18 to a flange 74 and passing the attachment means 20 through an aperture 76 in the flange 74 and the aperture 21 in the flange 18.

Figure 4:
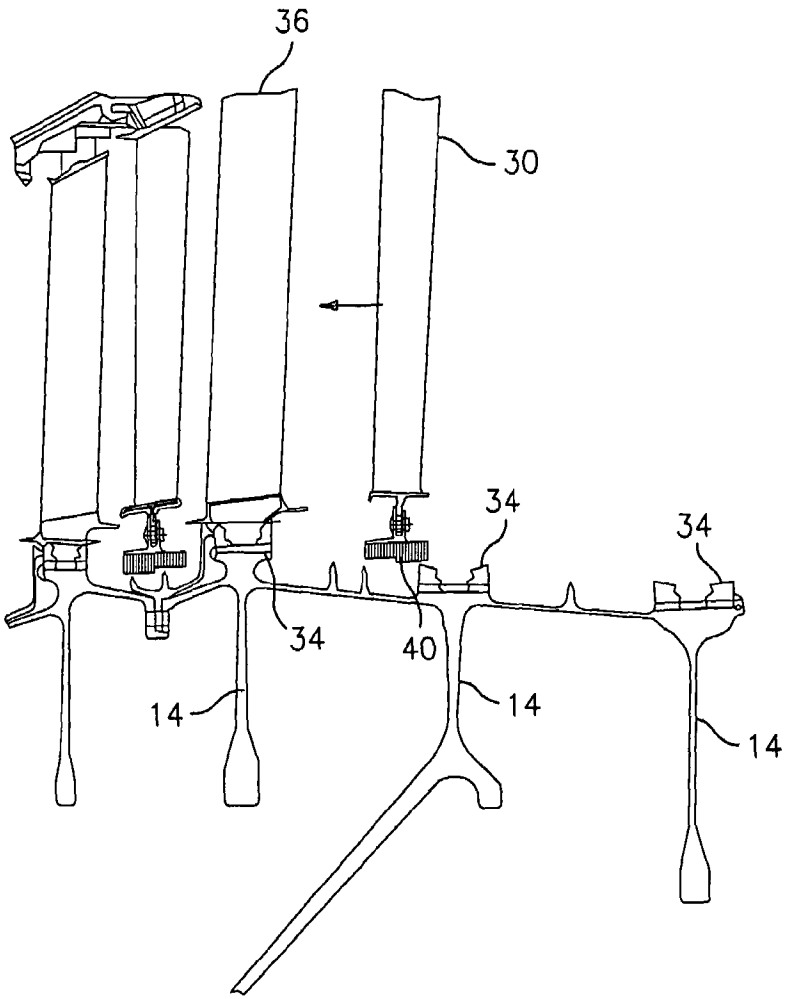
FIG. 4 illustrates a subsequent installation step in accordance with the present invention.

As shown in FIG. 4, a circumferential array of stator vanes 30 may then be installed due to the extra clearance of the downstream disk attachment. The array of stator vanes 30 may include a knife seal arrangement 40. As can be seen from FIG. 3, the seal arrangement 40 may include knife elements 42 integrally formed with the drum rotor 12.

After the stator vanes 30 are installed, a second array of turbine blades 26 may then be installed. After the array of turbine blades 26 is installed, an assembly of stator vanes 32 may be installed, and after the stator vanes 32, a third array of turbine blades 28 may be installed.

As can be seen from the foregoing description, the turbine structure 10 may be the last three stages of a low pressure turbine section of a gas turbine engine.

Figure 5:
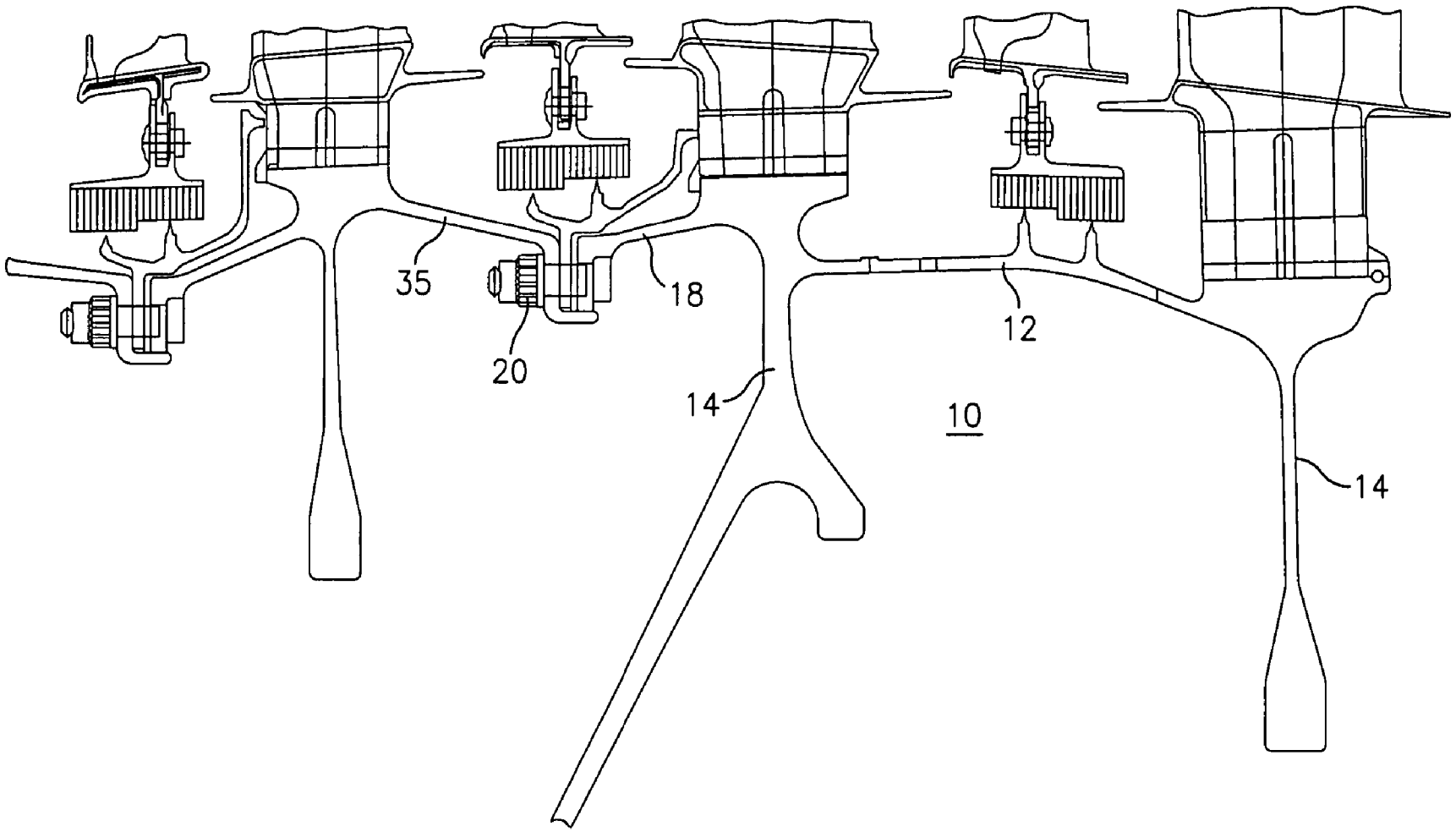
FIG. 5 illustrates a turbine structure embodiment having two stages.

While the turbine structure 10 has been showing as having three stages, it may only two stages if desired. Such a configuration is shown in FIG. 5. Also, if desired, the turbine structure 10 may have more than three stages.

It is apparent that there has been provided in accordance with the present invention a turbine drum rotor for a turbine engine which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A turbine structure for use in a gas turbine engine, comprising:

a one-piece drum rotor;

said drum rotor including a plurality of turbine disks welded together and having a first diameter at a leading one of said turbine disks and a second diameter at a trailing one of said turbine disks wherein said first diameter is greater than said second diameter;

said drum rotor having a plurality of integrally formed knife elements and an integrally formed flange for allowing said one-piece drum rotor to be joined to an adjacent structure, said flange being located near said leading one of said turbine disks;

at least one additional knife element positioned on a surface of said flange; and a plurality of turbine blades attached to said one-piece drum rotor.

2. A turbine structure according to claim 1, wherein each of said turbine disks has a plurality of integrally formed disk attachments for receiving an array of turbine blades.

3. A turbine structure according to claim 1, wherein said turbine structure forms part of a low pressure turbine for said engine.

4. A turbine structure according to claim 1, further comprising at least one stator vane array positioned intermediate adjacent arrays of said turbine blades.

5. A turbine according to claim 1, further comprising a nut and bolt arrangement for joining said rotor to said adjacent structure; and said flange having an opening for receiving said bolt.

6. A turbine structure according to claim 1, further comprising each of said turbine blades being attached to said one-piece drum rotor by a fir tree arrangement.

7. A method for installing a turbine structure into a turbine section of a gas turbine engine comprising the steps of:

installing a one-piece drum with an upstream set of turbine blades attached to said one-piece drum rotor and a plurality of disk attachments without turbine blades;

said installing step comprising joining said one-piece drum rotor to an adjacent structure via a leading edge flange and a nut and bolt arrangement; and thereafter installing a downstream set of turbine blades to said disk attachments.

8. A method according to claim 7, further comprising installing a first array of stator vanes relative to said one-piece drum rotor after said installing step.

9. A method according to claim 8, wherein said downstream set of turbine blades installing step comprises attaching a second set of turbine blades to said one-piece drum rotor downstream of said stator vane array.

10. A method according to claim 9, further comprises installing a second array of stator vanes downstream of said second set of turbine blades and thereafter installing a third set of turbine blades downstream of said second array of turbine blades.

11. A turbine section of a gas turbine engine comprising:

a first structure having an array of turbine blades and an array of stator vanes attached thereto;

a second structure attached to said first structure;

said second structure including a one-piece drum rotor and a plurality of spaced apart turbine blade arrays attached to said drum rotor;

said one-piece drum rotor comprising a plurality of turbine disks welded together, a first diameter at a leading one of said turbine disks and a second diameter at a trailing one of said turbine disks wherein said first diameter is greater than said second diameter, a plurality of integrally formed knife elements, and an integrally formed flange extending from said leading one of said turbine disks for allowing said one-piece drum rotor to be joined to said first structure which is positioned adjacent to said second structure;

said integrally formed flange having a first leg and a second leg at an angle to said first leg;

said first structure having an L-shaped flange with a third leg which extends parallel to said second leg and a fourth leg which extends at an angle to said third leg; and means for joining said integrally formed flange to said L-shaped flange so that when said flanges are joined together said fourth leg abuts an end of said second leg.

12. A turbine section according to claim 11, wherein said second structure forms at least the last two stages of the turbine section.

13. A turbine section according to claim 11, wherein said plurality of turbine disks includes a plurality of axially spaced apart turbine disks for supporting said turbine blades.

14. A turbine section according to claim 11, further comprising at least one array of stator vanes positioned between at least two adjacent ones of said turbine blade arrays.

15. A turbine section according to claim 11, further comprising each of said turbine blades being attached to said one-piece drum rotor by a fir tree arrangement.

* * * * *

UNITED STATES PATENT AND TRADEMARK OFFICE

CERTIFICATE OF CORRECTION

PATENT NO. : 7,128,535 B2
APPLICATION NO. : 10/720875
DATED : October 31, 2006
INVENTOR(S) : Gabrial Suciu and Brian Merry It is certified that error appears in the above-identified patent and that said Letters Patent is hereby corrected as shown below:

Title page, item [75] change inventor: Gabriel Sucin to --Gabrial Suciu--.

Signed and Sealed this

Sixteenth Day of November, 2010

David J. Kappos

David J. Kappos
*Director of the United States Patent and Trademark Office*